US008898978B2

(12) United States Patent
Murray et al.

(10) Patent No.: US 8,898,978 B2
(45) Date of Patent: Dec. 2, 2014

(54) INNOVATIVE BATTEN SYSTEM FOR ROOF TILE INSTALLATION

(71) Applicants: Pat L. Murray, Spring, TX (US); Robert L. Ferrante, Davie, FL (US)

(72) Inventors: Pat L. Murray, Spring, TX (US); Robert L. Ferrante, Davie, FL (US)

( * ) Notice: Subject to any disclaimer, the term of this patent is extended or adjusted under 35 U.S.C. 154(b) by 0 days.

(21) Appl. No.: 13/791,233

(22) Filed: Mar. 8, 2013

(65) Prior Publication Data

US 2014/0090320 A1 Apr. 3, 2014

Related U.S. Application Data

(60) Provisional application No. 61/676,146, filed on Jul. 26, 2012.

(51) Int. Cl.

| | |
|---|---|
| ***E04D 1/34*** | (2006.01) |
| ***E04D 12/00*** | (2006.01) |
| ***E04D 13/17*** | (2006.01) |

(52) U.S. Cl.

CPC ..... *E04D 12/004* (2013.01); *E04D 1/34* (2013.01); *E04D 13/17* (2013.01)

USPC ..... 52/302.3; 52/302.1; 52/478; 52/551; 52/535; 52/536; 52/746.11; 52/748.1

(58) Field of Classification Search

USPC ..... 52/409, 478, 539, 302.1, 302.3, 52/551–552, 535–536, 745.2, 746.11, 52/747.1, 747.11, 748.1

See application file for complete search history.

(56) References Cited

U.S. PATENT DOCUMENTS

| | | | | |
|---|---|---|---|---|
| 3,046,700 | A * | 7/1962 | Davenport | 52/409 |
| 4,202,319 | A * | 5/1980 | Vinz | 126/634 |
| 5,362,342 | A | 11/1994 | Murray | |
| 5,951,796 | A | 9/1999 | Murray | |
| 6,130,268 | A | 10/2000 | Murray | |
| 6,164,021 | A | 12/2000 | Huber | |
| 6,193,826 | B1 * | 2/2001 | Starr et al. | 156/71 |
| 6,718,719 | B1 * | 4/2004 | Hagerty | 52/553 |
| 7,249,443 | B2 | 7/2007 | Faulkner | |
| 7,316,099 | B2 | 1/2008 | Faulkner | |
| 7,748,191 | B2 * | 7/2010 | Podirsky | 52/536 |
| 8,453,399 | B2 * | 6/2013 | Anderson | 52/220.2 |
| 2002/0095898 | A1 * | 7/2002 | Bettencourt | 52/506.05 |
| 2005/0252140 | A1 * | 11/2005 | Faulkner et al. | 52/542 |
| 2008/0010933 | A1 | 1/2008 | Faulkner | |

FOREIGN PATENT DOCUMENTS

| | | | |
|---|---|---|---|
| JP | 09137556 | A * | 5/1997 |
| JP | 10102688 | A * | 4/1998 |
| JP | 2003013553 | A * | 1/2003 |

* cited by examiner

*Primary Examiner* — Jeanette E Chapman
(74) *Attorney, Agent, or Firm* — Douglas W. Rommelmann; Andrews Kurth LLP

(57) ABSTRACT

A roof tile installation assembly having a plurality of battens, each having a front end portion and a back end portion, and defining a channel between the front end portion and the back end portion, and at least one roof tile having a front end and a back end, the back end having a downwardly protruding flange. In use, the plurality of battens are preferably arranged parallel to one another on a rooftop so that the front end portion of each batten is toward the eave of the rooftop and the back end portion of each batten is toward the peak of the rooftop, and each roof tile flange is preferably arranged to be received by a batten channel so that the roof tile is substantially constrained from moving forward or backward relative to the batten so that the front end of each roof tile is arranged to be supported by the next adjacent batten.

28 Claims, 4 Drawing Sheets

INNOVATIVE BATTEN SYSTEM FOR ROOF TILE INSTALLATION

CROSS-REFERENCE TO RELATED APPLICATIONS

This application claims the benefit of U.S. Provisional Application Ser. No. 61/676,146 filed Jul. 26, 2012, entitled "Innovative Batten System for Roof Tile Installation." Applicant incorporates by reference herein U.S. Provisional Application Ser. No. 61/676,146 in its entirety.

FIELD OF THE INVENTION

The present invention generally relates to roof tile installation assemblies. More particularly, the present invention relates to a roof tile installation assembly that includes uniquely shaped battens that aid in installing roof tiles.

BACKGROUND AND SUMMARY OF THE INVENTION

Installation of roof tiles typically requires that battens, or thin strips of wood or metal, be attached to a roofing substrate. Thereafter roof tiles are attached to the battens, usually by nailing or otherwise fastening the tile to the battens along an upper edge of the tile. Known batten and roof tile arrangements, however, can give rise to problems.

For example, because most battens are made of wood or metal, they are subject to rot, corrosion, and decay. Thus, over time the battens may deteriorate. In addition, the manner in which roof tiles are attached to the battens (i.e. by fastening the tiles to the battens along a top edge of the tiles) leaves the roof tiles prone to tile rotation, which is a condition that occurs when wind pushes the eave end of a tile upward, causing the tile to rotate about its point of attachment to the batten. Tile rotation is undesirable and dangerous, because it causes the tiles to break free from the battens and fly through the air during high wind events. Both decay of the battens and tile rotation can be costly, requiring regular repair and maintenance of the roof.

What is needed therefore, is a roof tile installation system that overcomes the disadvantages of the prior art. For example, the present invention provides a roof tile installation assembly having a plurality of battens, each having a front end portion and a back end portion, and defining a channel between the front end portion and the back end portion, and at least one roof tile having a front end and a back end, the back end having a downwardly protruding flange. In use, the plurality of battens are preferably arranged parallel to one another on a rooftop so that the front end portion of each batten is toward the eave of the rooftop and the back end portion of each batten is toward the peak of the rooftop. In addition, each roof tile flange is preferably arranged to be received by the batten channel so that the roof tile is substantially constrained from moving forward or backward relative to the batten. Preferably, the front end of each roof tile is arranged to be supported by the next adjacent batten.

The present invention also provides a method of installing a roof tile assembly, including the step of attaching a plurality of battens to a rooftop, each of the battens having a front end portion and a back end portion, and defining a channel between the front end portion and the back end portion, the battens arranged parallel to one another on the rooftop so that the front end portion of each batten is toward the eave of the rooftop and the back end portion of each batten is toward the peak of the rooftop. The method further includes applying an adhesive to the back end portion of each batten, and attaching roof tiles to the battens, the roof tiles each having a front end and a back end, with a protruding flange at the back end, wherein each roof tile is arranged so that the protruding flange is received by the channel of a batten, and the roof tile is attached to an adjacent batten by contacting the adhesive of the adjacent batten at a place at or near the front end of the roof tile.

BRIEF DESCRIPTION OF THE SEVERAL VIEWS OF THE DRAWINGS

The present invention will be better understood on reading the following detailed description of nonlimiting embodiments thereof, and on examining the accompanying drawings, in which.

DESCRIPTION OF THE PREFERRED EMBODIMENTS

Figure 1:
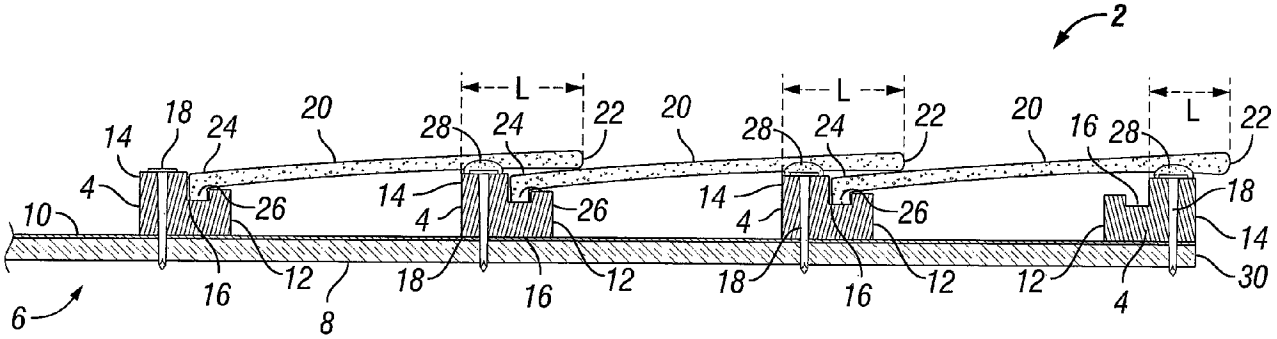
FIG. 1 is a side cross-sectional view of a roof tile installation assembly according to an embodiment of the present invention.

The foregoing aspects, features, and advantages of the present invention will be further appreciated when considered with reference to the following description of preferred embodiments and accompanying drawings, wherein like reference numerals represent like elements. In describing the preferred embodiments of the invention illustrated in the appended drawings, specific terminology will be used for the sake of clarity. However, the invention is not intended to be limited to the specific terms used, and it is to be understood that each specific term includes equivalents that operate in a similar manner to accomplish a similar purpose.

Referring now to the drawings, FIG. 1 shows a roof tile installation assembly 2 according to a preferred embodiment of the present invention. The assembly 2 includes battens 4 that are attached to a roofing substrate 6. The roofing substrate 6 may be composed of materials that are well known in the art. For example, the roofing substrate 6 may include a wood base 8 covered in underlayment 10, such as tar paper or felt. As shown in FIG. 1, the battens 4 preferably have a front end portion 12, a back end portion 14, and a channel 16 positioned between the front end portion 12 and the back end portion 14. The battens 4 may be attached to the roofing substrate 6 by any appropriate means, such as, for example, by fasteners 18, as shown, or by adhesive, depending on the requirements of the underlayment.

The roof tile installation assembly 2 further includes roof tiles 20 that rest on top of, and are preferably supported by, the battens 4. Each roof tile has a front or eave end 22, and a back or peak end 24. Each roof tile 20 also has a protruding flange 26 attached to the peak end 24. Preferably, the protruding flange 26 of each roof tile 20 is configured to engage the channel 16 of one of the battens 4. When thus engaged, and as best shown in FIG. 1, the protruding flange 26 interlocks with the first end portion 12 of the batten 4. Accordingly, the first end portion 12 of the batten 4 constrains forward movement of the roof tile 20 relative to the batten 4. Similarly, the back end portion 14 of the batten prevents the roof tile 20 from moving backward relative to the batten 4.

Figure 3:
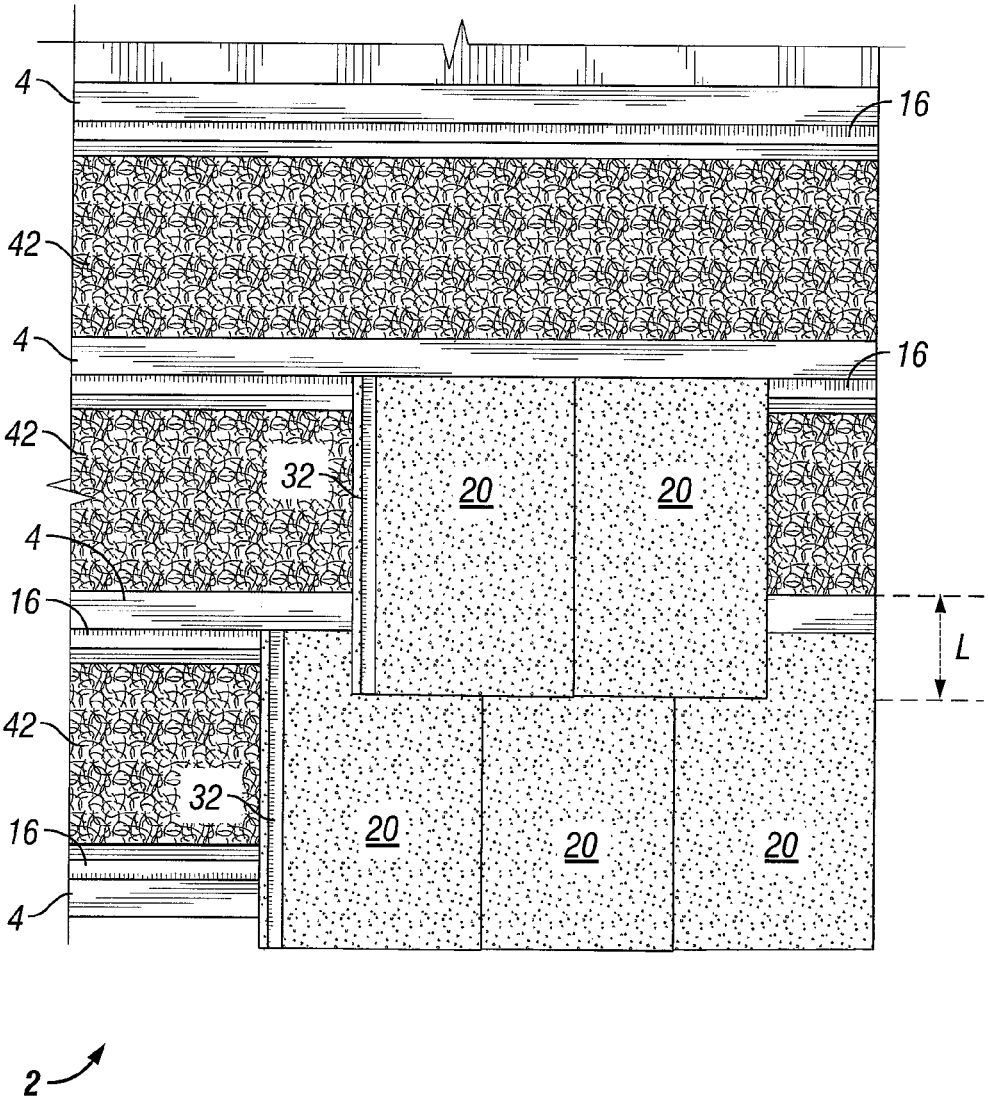
FIG. 3 is a top view of the roof tile installation assembly of FIG. 1.

In a preferred embodiment, the battens 4 are spaced a sufficient distance apart so that when the protruding flange 26 of a roof tile 20 is engaged with the channel 16 of a batten 4, the eave end 22 of the roof tile 20 overlaps the next adjacent batten 4. Preferably, the eave end 22 of the roof tile 20 also overlaps at least a back portion of another roof tile 20 that may be engaged with the adjacent batten 4. This overlap of the adjacent batten and a portion of an adjacent roof tile is indicated in FIG. 1 by the letter L, and is also shown in FIG. 3, which shows a top view of portions of the roof tile installation assembly 2 of FIG. 1.

Figure 2:
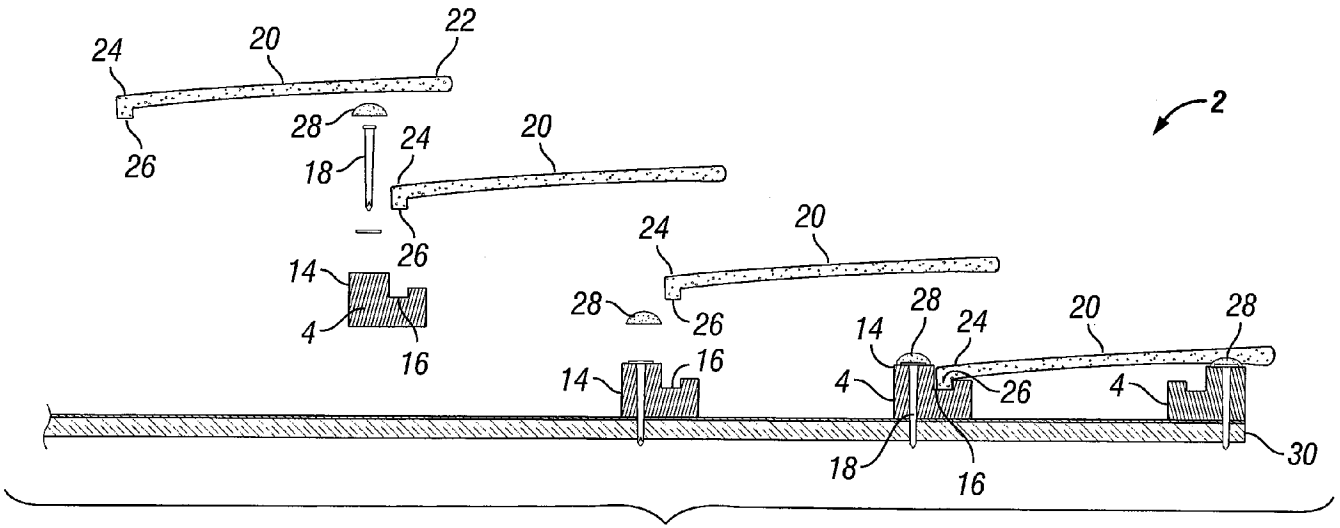
FIG. 2 is an exploded view of the roof tile installation assembly of FIG. 1, and further showing adhesive used to bond the roof tiles.

Referring now to FIG. 2, there is shown an exploded view of the roof tile installation assembly 2, including adhesive 28 used to attach the roof tiles 20 to the battens 4. As shown in FIG. 2, prior to placement of the roof tiles 20 on the battens 4, an adhesive 28 may preferably be applied to an upper surface of the back end portion 14 of each batten 4. Thus, as each roof tile 20 is placed over the battens 4, the protruding flange 26 of the peak end 24 of the roof tile 20 is received by the channel 16 of the batten 4, as described above, and the part of the roof tile 20 that comes into contact with the back end portion 14 of the next adjacent batten 4 (usually near the eave end 22 of the roof tile 20) is adhered thereto by the adhesive 28.

One advantage of adhering the roof tiles to the battens in this way is that it substantially reduces tile rotation. Tile rotation is a problem that affects known roof tiles, which are typically fastened to battens only at the peak end of the tile. When the tiles are exposed to high winds, the winds will often lift the eave end of the tile upward, causing the tile to rotate about its peak end, and often breaking the tile loose from the batten. The roof tiles of the present invention, however, are adhered to the battens at a position near the eave end of the tiles, as described above. Thus, wind is not able to lift the eave end of the tile upward or to cause the tile to rotate about its peak end. This feature enables use of the tiles in areas of high wind where conventional roof tiles may not be used. In fact, this feature may increase the resistance of the tiles to wind rotations by 30% to 60% or more. Preferably, the battens 4 of the present embodiment are positioned so that the adhesive contacts the tile at a distance from the eave end of the tile at a place where the highest negative pressures are realized during a wind event.

Also as shown in FIGS. 1 and 2, the batten 4 closest to the eave of the roof 30 may be reversed so that the back end portion 14 of the batten 4 is toward the eave 30 and the front end portion 12 of the batten 4 is toward the peak of the roof.

FIG. 3 shows a top view of a preferred embodiment of the present invention, including battens 4 and roof tiles 20. This view also shows the overlap L between roof tiles in one row and roof tiles in an adjacent row. Although not required, also shown is a side lap 32 which may preferably be located along both side edges of each roof tile 20. The side lap is configured to engage a corresponding side lap (not shown) on the side edge of an adjacent roof tile such that the roof tile overlaps the side edge of the adjacent roof tile. When corresponding side laps are engaged on adjacent roof tiles, the side laps 32 preferably fix the tiles one to another so they restrict relative movement in a lateral direction. In addition, the interface between the corresponding side laps 32 is preferably water tight.

FIG. 3 also shows how the battens 4, when properly installed so that they are positioned on the roofing substrate parallel to one another, help to align the tile during installation. The channels 16 in the battens 4 are straight so that when they receive the protruding flanges 26 of the roof tiles 20, the roof tiles 20 also will be straight. This feature also increases the installation speed of the roof tile assembly.

FIG. 3 also shows how insulation board 42, or other insulating material, may be placed between the batten strips to insulate the interior space beneath the roof. The insulation 42 could be separate from the battens, and placed in between the battens underneath the roof tiles, or it could be attached to or integral with the battens. The addition of such insulation underneath the roof tiles could advantageously reduce the heat load in the attic or other interior space beneath the roof, thereby saving energy.

Figure 4A:
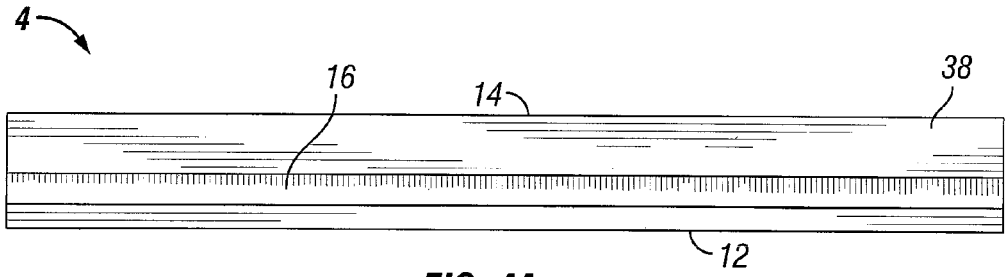
FIG. 4A is a top view of a batten according to one embodiment of the present invention.
Figure 4B:
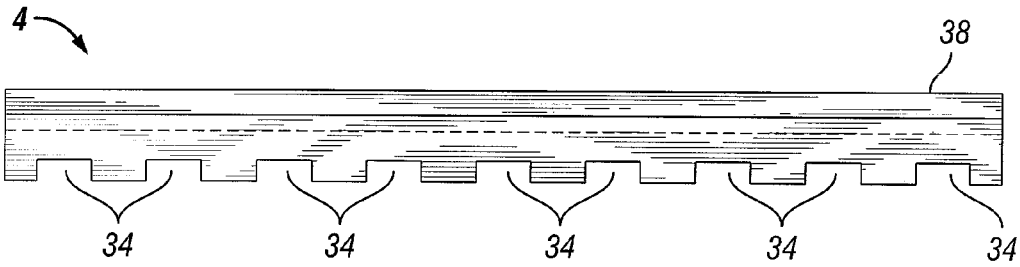
FIG. 4B is a front view of the batten of FIG. 4A.
Figure 4C:
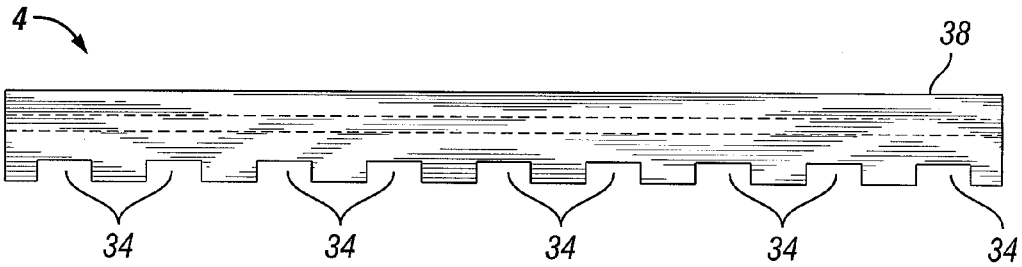
FIG. 4C is a back view of the batten of FIGS. 4A and 4B.
Figure 4D:
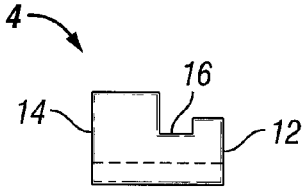
FIG. 4D is an end view of the batten of FIGS. 4A-4C.

Referring now to FIGS. 4A-4D, there is shown an embodiment of the batten 4 as used in the roof tile installation system of the present invention. FIG. 4A shows a top view of the batten 4, including front end portion 12, back end portion 14, and channel 16. FIG. 4D shows a side view of the batten 4, which similarly shows the front end portion 12, back end portion 14, and channel 16.

FIGS. 4B and 4C show front and back views of the batten 4 respectively, including flutes 34 on the bottom surface of the batten 4. One purpose of the flutes 34 is to promote air circulation and moisture dissipation between the battens 4 and the roofing substrate to which they are mounted by allowing air and water to flow underneath the battens. This eliminates the damming of water (a problem inherent with many known wood or metal batten systems), and increases the longevity of the underlayment components. The spacing of the flutes 34 may vary, and may be determined by the spacing of the fasteners 18 which attach the battens 4 to the roofing substrate. The number of fasteners may in turn be determined by the required wind uplift resistance for the geographic area in which the roof is located.

Although the top surface 38 of the battens 4 is flat in FIGS. 4B-4D, some embodiments of the battens may have a curved top surface, such as to match curved tile profiles (e.g., the profiles of double roll, Spanish S, or barrel tiles). Thus, the battens may be profile specific, thereby allowing the quantity of adhesive between the battens and the roof tiles to be reduced, and helping to ensure that the adhesive is applied in the proper position.

Known battens are typically made of wood, including pressure-treated wood, or metal. Wood battens inherently contain moisture, which causes rot and prevents adhesive from bonding well to the battens. Similarly, metal battens corrode and typically have oil residue from manufacturing affecting or limiting the bond of the adhesive. One advantage of some embodiments of the present invention, therefore, is that the battens are constructed of corrosion resistant materials that resist deterioration over time. For example, the battens may be made of molded or hot wire cut polystyrene, molded or extruded polyvinyl chloride (PVC), molded or cut polyurethane, molded or extruded polyethylene or polypropylene, etc. Such cellular or non-cellular plastics do not deteriorate as rapidly as wood, and do not contain moisture.

Figure 5:
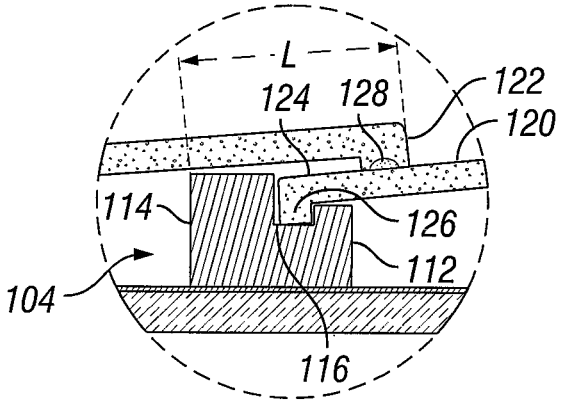
FIG. 5 is a side cross-sectional view of a roof tile installation assembly according to another embodiment of the present invention.

FIG. 5 shows another embodiment of the present invention. In this embodiment, as in the embodiment disclosed above with respect to, for example, FIG. 2, the peak end 124 of the roof tile 120 has a protruding flange 126 that is configured to interlock with the channel 116 of batten 104. Likewise the eave end 122 of an adjacent roof tile 120 overlaps the batten 104 and a portion of the roof tile 120 by a distance L. One difference between the embodiment of FIG. 5, however, and that of FIG. 2, is in the way that the roof tile is adhered to the adjacent batten and tile. That is, in the embodiment of FIG. 2 the roof tile is attached by an adhesive 28 to the back end portion 14 of the adjacent batten 4. In contrast, the roof tile of FIG. 5 is attached by an adhesive 128 to the adjacent roof tile 120. Such a configuration may be advantageous, for example, by allowing each tile to be adhered nearer to the eave end 122 of the tile, thereby increasing resistance to tile rotation.

Figure 6:
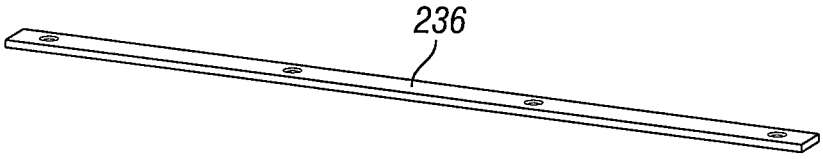
FIG. 6 is a perspective view of a fastening strip according to an embodiment of the present invention.
Figure 7:
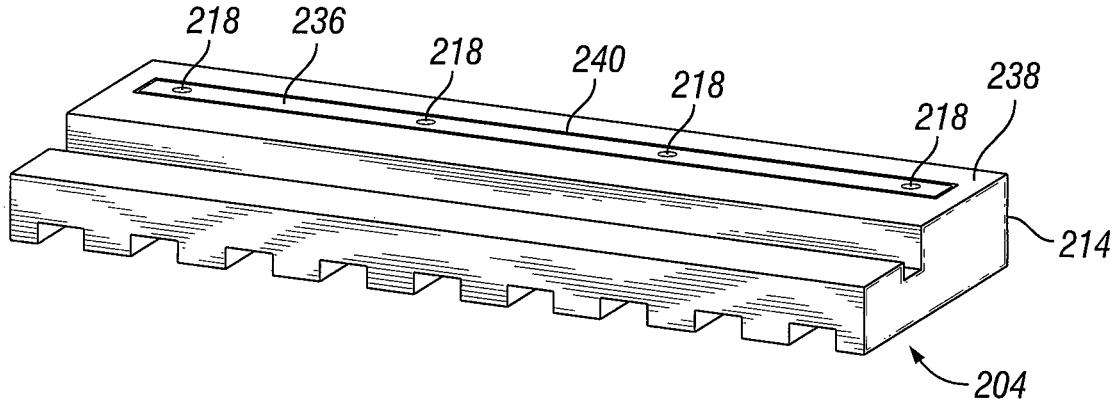
FIG. 7 is a perspective view of a batten according to an embodiment of the present invention with the fastening strip of FIG. 6 attached thereto.

FIG. 6 shows a fastening strip 236 that may be used in one preferred embodiment of the invention. As shown in FIG. 7, the fastening strip 236 is configured for attachment along an upper surface 238 of the back end portion 214 of a batten strip 204. The fastening strip 236 may be attached to the batten 204 in any acceptable way, such as, for example, by fasteners 218. Thus attached, the fastening strip 236 provides a surface to which adhesive readily adheres.

The fastening strip 236 is preferably made of a material that resists deterioration, such as, for example, metal, extruded PVC, polyethylene, polypropylene, fiber reinforced rubber, etc. In addition, the surface 240 of the fastening strip 236 may be flat or it may be stepped in such a way as to minimize the quantity of adhesive necessary to create a bond between the fastening strip and a roof tile.

To install the roof tile assembly, the battens are first attached to the substrate. This may be done by mechanical fasteners, such as screws or nails, or by adhesive, depending on the underlayment. Insulation may optionally be placed between the battens. With the battens in place, adhesive may be applied to the battens as shown, for example, in FIG. 2, and the roof tiles are placed so that the protruding flanges engage the channels of the battens. Alternatively, the adhesive may be applied to an upper surface of each roof tile near the peak end, as shown in FIG. 5, so that an overlapping tile may be bonded directly to the tile. In particular where the roof has a steep pitch, it may be advantageous to tack or nail each roof tile to the batten at its peak end to hold the roof tile in place while the adhesive sets.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A roof tile installation assembly, comprising:

a plurality of battens, each having a front end portion and a back end portion, and defining a channel between the front end portion and the back end portion; and at least one roof tile having a front end and a back end, the back end having a downwardly protruding flange;

wherein in use the plurality of battens are arranged parallel to one another on a rooftop so that the front end portion of each batten is toward the eave of the rooftop and the back end portion of each batten is toward the peak of the rooftop;

wherein each roof tile flange is arranged to be received by a batten channel so that the roof tile is substantially constrained from moving forward or backward relative to the batten; and means for fixedly attaching the back end portion of each adjacent batten to the roof tile that it supports.

2. The roof tile installation assembly of claim 1, wherein the means is an adhesive.

3. The roof tile installation assembly of claim 1, wherein the front end of each roof tile overlaps the back end of at least one roof tile.

4. The roof tile installation assembly of claim 1, wherein each roof tile has a first side lap on one side edge, and a second side lap on an opposing side edge, and wherein the first side lap of each tile is arranged and designed to engage the second side lap of an adjacent tile.

5. The roof tile installation assembly of claim 4, wherein the engagement interface between the first and second side laps of adjacent roof tiles is water tight.

6. The roof tile installation assembly of claim 1, further comprising insulation configured for placement between the battens and underneath the roof tiles between the roof tiles and the rooftop.

7. The roof tile installation assembly of claim 1, wherein each batten has a bottom surface arranged to contact the rooftop, and wherein the bottom surface defines flutes, the flutes arranged and designed to allow water and air to travel underneath each batten between the batten and the rooftop.

8. The roof tile installation assembly of claim 1, wherein each batten has a top surface arranged and designed to contact an adjacent roof tile, and wherein the top surface is contoured to match the shape of the roof tile.

9. The roof tile installation assembly of claim 1, wherein the battens are made of a material selected from the group consisting of molded or hot wire cut polystyrene, molded or extruded polyvinyl chloride (PVC), molded or cut polyurethane, and molded or extruded polyethylene or polypropylene.

10. The roof tile installation assembly of claim 1, further comprising fastening strips arranged and designed for attachment on a top surface of each batten.

11. The roof tile installation assembly of claim 10, wherein the fastening strips are made of a material selected from the group consisting of metal, extruded PVC, polyethylene, polypropylene, and fiber reinforced rubber.

12. A method of installing a tile roofing assembly on a pitched roof deck, comprising:

attaching a plurality of battens to the roof deck, each of the battens having a front end portion and a back end portion, and defining an upward-facing channel between the front end portion and the back end portion, the battens spatially arranged parallel to one another along the pitch of the roof deck, wherein the step of attaching the plurality of battens to the roof deck comprises nailing a fastening strip, in contact with an upper surface of the back end portion of the batten, to the roof deck;

applying an adhesive to the upper surface of the back end portion of each batten; and attaching roof tiles to the battens, the roof tiles each having an eave end and a peak end, and a downwardly protruding flange at the peak end, wherein each roof tile is arranged so that the downwardly protruding flange is received in the channel of a batten, and a portion of a lower surface of the roof tile is adhered to an adjacent batten by contacting the adhesive applied to the upper surface of the adjacent batten.

13. The method of claim 12, wherein the battens are made of a material selected from the group consisting of molded or hot wire cut polystyrene, molded or extruded polyvinyl chloride (PVC), molded or cut polyurethane, and molded or extruded polyethylene or polypropylene.

14. The method of claim 12, wherein the spatial arrangement of the battens on the roof deck results in the eave end of an upper roof tile overlapping the peak end of the adjacent lower roof tile, and the portion of the lower surface of the adjacent upper roof tile adhered to the upper surface of the adjacent lower batten is near the location of tile overlap.

15. A roof tile installation assembly, comprising:

a plurality of battens, each having a front end portion and a back end portion, and defining a channel between the front end portion and the back end portion;

at least one roof tile having a front end and a back end, the back end having a downwardly protruding flange;

wherein in use the plurality of battens are arranged parallel to one another on a rooftop so that the front end portion of each batten is toward the eave of the rooftop and the back end portion of each batten is toward the peak of the rooftop;

wherein each roof tile flange is arranged to be received by a batten channel so that the roof tile is substantially constrained from moving forward or backward relative to the batten; and wherein the front end of each roof tile is arranged to be supported by the next adjacent batten;

means for fixedly attaching the front end of each roof tile with the back end of at least one forwardly adjacent roof tile; and an end batten proximate the eave of the rooftop, wherein the end batten has the same structure as the plurality of battens, but is reversed so that the back end portion of the batten is toward the eave of the rooftop.

16. The roof tile installation assembly of claim 15, wherein the means is an adhesive.

17. The roof tile installation assembly of claim 15, wherein the front end of each roof tile overlaps the back end of at least one roof tile.

18. The roof tile installation assembly of claim 15, wherein each roof tile has a first side lap on one side edge, and a second side lap on an opposing side edge, and wherein the first side lap of each tile is arranged and designed to engage the second side lap of an adjacent tile.

19. The roof tile installation assembly of claim 18, wherein the engagement interface between the first and second side laps of adjacent roof tiles is water tight.

20. The roof tile installation assembly of claim 15, further comprising insulation configured for placement between the battens and underneath the roof tiles between the roof tiles and the rooftop.

21. The roof tile installation assembly of claim 15, wherein each batten has a bottom surface arranged to contact the rooftop, and wherein the bottom surface defines flutes, the flutes arranged and designed to allow water and air to travel underneath each batten between the batten and the rooftop.

22. The roof tile installation assembly of claim 15, wherein each batten has a top surface arranged and designed to contact an adjacent roof tile, and wherein the top surface is contoured to match the shape of the roof tile.

23. The roof tile installation assembly of claim 15, wherein the battens are made of a material selected from the group consisting of molded or hot wire cut polystyrene, molded or extruded polyvinyl chloride (PVC), molded or cut polyurethane, and molded or extruded polyethylene or polypropylene.

24. The roof tile installation assembly of claim 15, further comprising fastening strips arranged and designed for attachment on a top surface of each batten.

25. The roof tile installation assembly of claim 15, wherein the fastening strips are made of a material selected from the group consisting of metal, extruded PVC, polyethylene, polypropylene, and fiber reinforced rubber.

26. A method for installing a tile roof assembly on a roofing substrate, comprising:

providing a plurality of roof tiles having an eave end, a peak end and a downwardly protruding flange at the peak end;

providing a plurality of battens, each batten comprising an elongate body having an elongate front end portion, an elongate back end portion and an elongate channel between the front and back end portions, the batten having a lower surface adapted to engage the roofing substrate, the lower surface including a plurality of recessed flutes extending below and substantially transverse to the elongated channel adapted to allow water and air to flow beneath the batten, the batten having an upper surface with the upper surface of the back end portion being above the upper surface of the front end portion, wherein the upper surface of the back end portion of the batten includes an elongate fastening strip adapted to provide a surface to which adhesive readily adheres;

providing an adhesive adapted to adhere the roof tile to the batten;

wherein the elongate channel of a batten is adapted to receive and engage the downwardly protruding flange of the roof tile, and the upper surface of the back end portion of an adjacent batten is adapted to be adhered to a portion of a lower surface of the roof tile proximate the eave end of the roof tile.

27. A tile roof installation kit for installing roof tiles on a roofing substrate, comprising:

a plurality of battens, each batten comprising an elongate body having an elongate front end portion, an elongate back end portion and an elongate channel between the front and back end portions, the batten having a lower surface adapted to engage the roofing substrate, the lower surface including a plurality of recessed flutes extending below and substantially transverse to the elongated channel adapted to allow water and air to flow beneath the batten, the batten having an upper surface with the upper surface of the back end portion being above the upper surface of the front end portion;

a plurality of elongate fastening strips configured for attachment to the plurality of battens and for providing an upper surface to which adhesive readily adheres; and an adhesive adapted to adhere the roof tile to the elongate fastening strip and batten, wherein the elongate channel of a batten is adapted to receive and engage the downwardly protruding flange of the roof tile, and the upper surface of the back end portion of an adjacent batten is adapted to be adhered to a portion of a lower surface of the roof tile proximate the eave end of the roof tile.

28. The kit of claim 27, wherein the upper surface of the fastening strip is stepped to minimize the quantity of adhesive necessary to create a bond between the fastening strip and the roof tile.

* * * * *